US008551317B2

(12) United States Patent
Kurokawa et al.

(10) Patent No.: US 8,551,317 B2
(45) Date of Patent: Oct. 8, 2013

(54) METHOD AND APPARATUS FOR FORMING OXIDE COATING

(75) Inventors: Wataru Kurokawa, Yokohama (JP); Hiroshi Matsubayashi, Yokohama (JP); Mitsuhide Aihara, Yokohama (JP); Masanobu Matsubara, Kudamatsu (JP); Masatoki Ishida, Kudamatsu (JP); Norimasa Maida, Kudamatsu (JP)

(73) Assignees: Toyo Seikan Kaisha, Ltd., Tokyo (JP); Toyo Kohan Co., Ltd., Tokyo (JP)

( * ) Notice: Subject to any disclaimer, the term of this patent is extended or adjusted under 35 U.S.C. 154(b) by 1083 days.

(21) Appl. No.: 10/583,775

(22) PCT Filed: Nov. 9, 2004

(86) PCT No.: PCT/JP2004/016565

§ 371 (c)(1),
(2), (4) Date: Apr. 23, 2009

(87) PCT Pub. No.: WO2005/066393

PCT Pub. Date: Jul. 21, 2005

(65) Prior Publication Data

US 2009/0205965 A1 Aug. 20, 2009

(30) Foreign Application Priority Data

Dec. 26, 2003 (JP) ..... 2003-432983
Oct. 28, 2004 (JP) ..... 2004-314500

(51) Int. Cl.
*C25D 9/10* (2006.01)
*C25D 17/00* (2006.01)
*C25D 17/10* (2006.01)

(52) U.S. Cl.
USPC ..... 205/320; 204/277; 204/290.12; 205/148; 205/333

(58) Field of Classification Search
USPC ..... 205/277, 148, 333, 320; 204/277
See application file for complete search history.

(56) References Cited

U.S. PATENT DOCUMENTS

| | | | | | |
|---|---|---|---|---|---|
| 2,820,748 | A * | 1/1958 | Von Bichowsky | ..... | 205/560 |
| 3,928,152 | A * | 12/1975 | Harvey et al. | ..... | 205/576 |
| 4,042,471 | A * | 8/1977 | Hasegawa et al. | ..... | 205/173 |
| 4,116,695 | A * | 9/1978 | Mori et al. | ..... | 430/164 |
| 4,211,619 | A * | 7/1980 | Usbeck | ..... | 205/153 |
| 4,419,650 | A * | 12/1983 | John | ..... | 337/119 |
| 4,934,307 | A * | 6/1990 | Sumiyoshi | ..... | 118/74 |
| 6,251,289 | B1 * | 6/2001 | Sherman | ..... | 210/758 |
| 2002/0054998 | A1 * | 5/2002 | Heimann et al. | ..... | 428/446 |

FOREIGN PATENT DOCUMENTS

| | | | |
|---|---|---|---|
| JP | H05-065697 | A | 3/1993 |
| JP | H06-033295 | A | 2/1994 |
| JP | H09-031403 | A | 7/1995 |

(Continued)

*Primary Examiner* — Patrick Ryan
*Assistant Examiner* — William Leader
(74) *Attorney, Agent, or Firm* — Browdy and Neimark, PLLC

(57) ABSTRACT

Disclosed are a method and an apparatus for forming an oxide coating film with excellent corrosion resistance and adhesiveness on a cathode made of a metal plate by a simple process at low cost. A direct current voltage is applied between an anode (12) and a cathode (13) in an electrolyte solution which cathode (13) is made of a metal plate to be coated with oxide and arranged opposite to the anode (12), while supplying oxygen or a gas containing oxygen into the electrolyte solution, so that the metal plate cathode (13) is coated with oxide, thereby being formed into a oxide-coated metal plate.

6 Claims, 1 Drawing Sheet

(56) References Cited

FOREIGN PATENT DOCUMENTS

| | | | |
|---|---|---|---|
| JP | H11-264093 | A | 8/1999 |
| JP | 2000-040599 | A | 2/2000 |
| JP | 2001-172772 | A | 6/2001 |
| JP | 2001-240979 | A | 8/2001 |

* cited by examiner

METHOD AND APPARATUS FOR FORMING OXIDE COATING

TECHNICAL FIELD

The present invention relates to an oxide coating method for coating a metal plate with an oxide and an oxide coating apparatus used for forming an oxide film.

BACKGROUND ART

It has been usual practice to give chemical treatment to the surface of a metallic material used for a container for packing food or drink, such as a steel sheet, a tin plate made by coating a steel sheet with tin, or aluminum, to form an oxide or hydroxide film on its surface to improve its corrosion resistance and coating adhesion, particularly its coating adhesion as required when it is processed. An oxide film is formed by forming an oxide directly on the surface of a metallic material, or by forming a hydroxide on the surface of a metallic material and causing it to react with oxygen in the air to form an oxide. There is also a hydroxide reacting only slowly with oxygen in the air. For simplicity of description, these oxides, hydrous oxides and hydroxides will hereinafter be referred to merely as oxides. A method relying on dipping a metal plate in a treating solution or a method relying on electrolysis in a treating solution is employed as a method of forming an oxide film. The method relying on dipping is a simple and convenient method of treatment, but is likely to be able to form only a film having too small a thickness to exhibit any satisfactory corrosion resistance or coating adhesion as intended. The method relying on electrolysis, which forms an oxide film instead of a film of metal plating, involves difficulty in achieving an adequate control of various conditions including the bath composition containing an oxidizing agent, its pH and the conditions of electrolysis and is not beneficial from a cost standpoint, either, as it requires a larger amount of electricity than metal plating.

Technique as shown below is, for example, disclosed as a technique for forming an oxide film on the surface of a metal plate. Patent Literature 1 discloses a method in which not a tin plate, but a DI tin can made by drawing and ironing a tin plate is brought into contact with a surface treating solution containing a water-soluble composition containing a phosphate ion, a condensed phosphate ion and a water-soluble polymer so that corrosion resistance and paint adhesion may be imparted to the can surface before coating or printing, but as it is a method of forming a film on the surface of a can body after its processing, and is not intended for improving the adhesion of a coating during its processing, but can form only a very thin film, it is not applicable as a method for chemical treatment of a flat sheet yet to be processed.

Patent Literature 2 discloses a method of forming a considerably thick film on a metallic material including a tin-plated steel sheet by its surface treatment with a metal surface treating agent for a precoated steel sheet containing a silane coupling agent and/or a hydrolysis condensate thereof, water-dispersible silica and a zirconium compound, but when this metal surface treating agent is applied to a tin-plated steel sheet used as a can material, no satisfactory corrosion resistance can be obtained if it is used without the addition of any water-dispersible silica as it makes a film too thick.

The following is the prior art literature information pertaining to the present application:

Patent Literature 1: Official Gazette JP-A-Hei-09-031403

Patent Literature 2: Official Gazette JP-A-2001-240979

DISCLOSURE OF THE INVENTION

Problems to be Solved by the Invention

The present invention is aimed at providing by employing a simpler and more convenient method, a method of oxide coating which is inexpensive and has excellent corrosion resistance and coating adhesion, and an oxide coating apparatus used for forming an oxide film.

Means for Solving the Problems

The oxide coating method of the present invention which solves the above problems is an oxide coating method characterized by applying a direct current voltage between an anode and a cathode formed from a metal plate to be coated with an oxide, which is positioned (situated) opposite the anode in an electrolyte, and supplying gas into the electrolyte to coat it with the oxide (claim 1), or an oxide coating method as set forth above (claim 1), wherein the gas is oxygen, or a gas containing oxygen (claim 2), or an oxide coating method as set forth above (claim 1 or 2), wherein the gas is supplied through bubble generating means situated below or beside the space between the anode and cathode (claim 3), or an oxide coating method as set forth above (claim 1, 2 or 3), wherein the gas is supplied in the form of fine bubbles (claim 4), or an oxide coating method as set forth above (claim 1, 2, 3 or 4), wherein the gas is so supplied as to contact the cathode surface (claim 5).

The oxide coating apparatus of the present invention is an oxide coating apparatus characterized by having an anode and a cathode situated opposite the anode in an electrolyte and formed from a metal plate to be coated with an oxide, and bubble generating means for supplying gas into the electrolyte (claim 6), or an oxide coating apparatus as set forth above (claim 6), wherein the anode is an insoluble anode (claim 7), or an oxide coating apparatus as set forth above (claim 6 or 7), wherein the gas is oxygen, or a gas containing oxygen (claim 8), or an oxide coating apparatus as set forth above (claim 6, 7 or 8), wherein the bubble generating means is situated below or beside the space between the anode and cathode (claim 9), or an oxide coating apparatus as set forth above (claim 6, 7, 8 or 9), wherein the bubble generating means is a porous body connected to a source of gas supply (claim 10), or an oxide coating apparatus as set forth above (claim 10), wherein the porous body has a pore diameter of 1 to 1,000 μm and a void ratio of 5 to 95% (claim 11), or an oxide coating apparatus as set forth above (claim 10 or 11), wherein the porous body is a sintered body of any of a metal powder, a ceramic powder and an organic resin powder (claim 12), or a foamed product of any of a foamed metal, a foamed ceramic and a foamed organic resin having open cells (claim 13).

BEST MODE OF CARRYING OUT THE INVENTION (Oxide Coating Method and Apparatus)

Figure 1:
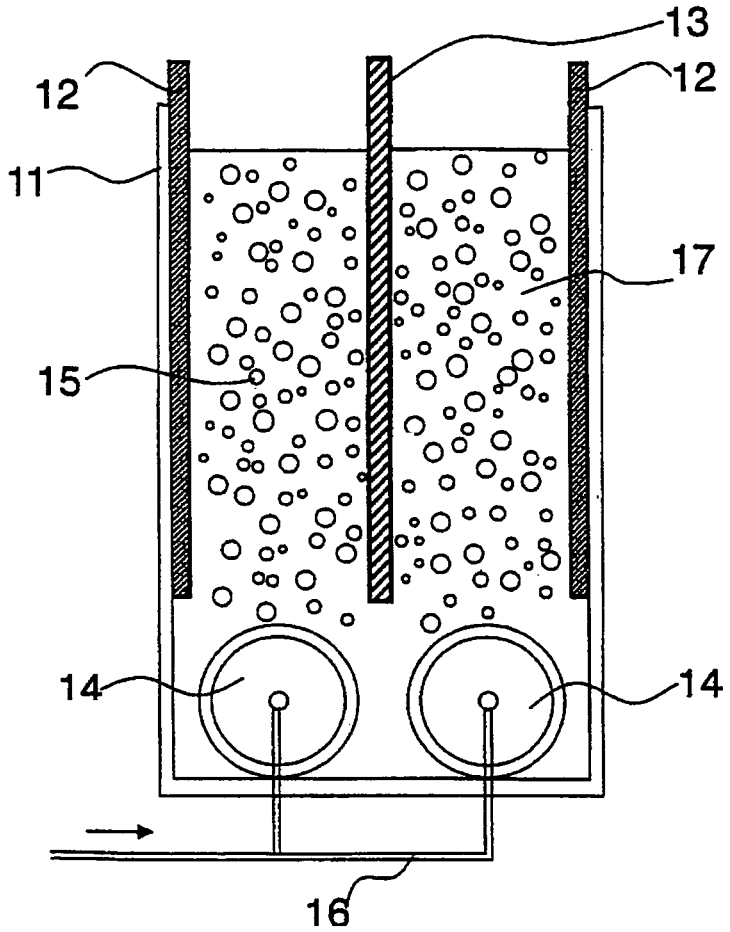
FIG. 1 is a schematic sectional view showing an example of oxide coating apparatus according to the present invention.

The present invention will now be described in detail by way of a preferred example in which oxygen gas is employed as the gas supplied into the electrolyte near the surface of a metal plate defining the cathode. FIG. 1 shows an example of oxide coating apparatus according to the present invention.

FIG. 1 shows the case in which an oxide film is formed on both sides of the metal plate 13 defining the cathode. Parallel anodes 12 facing each other are installed on the opposite sides, respectively, of the metal plate 13 in an electrolytic cell 11 filled with the electrolyte 17. The metal plate 13 and the anodes 12 are electrically connected to a direct current power source, though it is not shown. Bubble generating means 14 is installed between the metal plate 13 and the anodes 12 in the lower portion of the electrolytic cell 11, so that a gas containing oxygen may be supplied from a gas stream generating source, such as an oxygen bottle and an air compressor, to the bubble generating means 14 through a pipe 16, and so that the bubble generating means 14 may generate fine bubbles 15 through its porous portion into the electrolyte 17. While fine bubbles 15 of oxygen gas are supplied into the electrolyte 17 so as to contact the cathode metal plate 13, a direct current voltage is applied between the cathode metal plate 13 and the anodes 12 to form an oxide film on the surfaces of the metal plate 13.

If electrolysis is performed without any such gas being supplied into the electrolyte 17, on the other hand, the source of oxygen for the oxide film formed on the cathode 13 is limited to oxygen dissolved in the electrolyte, or oxygen formed at the anodes 12 during electrolysis and the arrival of oxygen at the cathode 13 determines the rate of formation of the oxide film.

As the metal plate 13, it is possible to employ not only a low carbon steel sheet as a container material, or plated steel sheet made by coating a low carbon steel sheet with tin or nickel, but also zinc-coated steel sheet, zinc alloy-coated steel sheet, stainless steel sheet, aluminum alloy sheet, copper sheet, copper alloy sheet, nickel sheet, nickel alloy sheet, etc.

The anodes 12 may be soluble anodes formed from the same metal as the metal forming the oxide film to be formed, and capable of supplying the ion of that metal, or insoluble anodes participating merely in the transportation of electrons.

Figure 2:
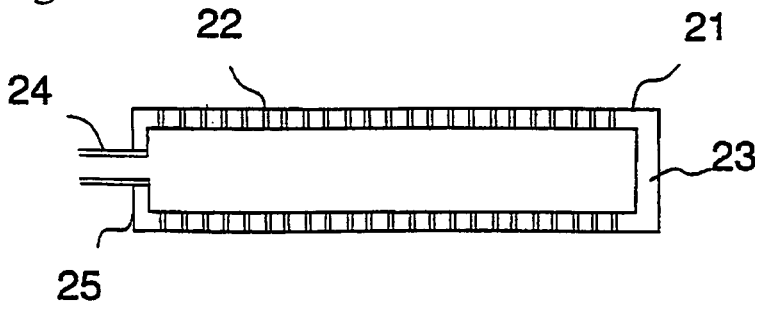
FIG. 2 is a schematic sectional view showing an example of bubble generating means used in the oxide coating apparatus of the present invention. Referring to the symbols in the drawing, 11 denotes an electrolytic cell, 12 denotes an anode, 13 denotes a cathode (metal plate), 14 denotes bubble generating means, 15 denotes bubbles, 16 denotes a pipe, 17 denotes an electrolyte, 21 denotes a hollow cylindrical body, 22 denotes a porous body, 23 denotes one end of the cylindrical body, 25 denotes the other end of the cylindrical body and 24 denotes a pipe connector.

The bubble generating means 14 preferably has a porous layer formed on its surface to form bubbles from the entire surface of its porous layer to generate fine bubbles of oxygen gas into the electrolyte 17. It may, for example, be formed by a hollow cylindrical body 21 composed of a porous body 22 and having one end 23 closed tightly, while a pipe connector 24 for supplying oxygen gas is formed at the other end 25 thereof, as shown in FIG. 2. The porous body 22 may, for example, be a porous sintered product made by sintering a metal powder, ceramic powder or an organic resin powder and used as a filter, etc., or a foamed product of a metal, ceramic or organic resin having open cells formed therein.

The porous body 22 preferably has a pore diameter of 1 to 1,000 μm. A porous body 22 having a pore diameter of less than 1 μm is very difficult to produce and is easily clogged during its use. A porous body having a pore diameter exceeding 1,000 μm generates so large bubbles that an oxide film is difficult to form and is likely to be uneven in adhesion. The porous body 22 is also required to have a void ratio of 5 to 95%. A porous body having a void ratio of less than 5% generates so small an amount of bubbles that an oxide film is difficult to form, and a porous body 22 having a void ratio exceeding 95% makes the generation of bubbles uneven along its length, or along the width of the metal plate 13. The cylindrical body 21 may have any shape in cross section, such as circular, oval, square or otherwise polygonal.

It is preferable to employ pure oxygen or air as oxygen for the oxygen gas generated in the form of fine bubbles in the electrolyte 17, since it does not adversely affect the environment, and it is more preferable from the standpoints of work safety and cost to use air compressed by a compressor, etc.

The present invention does not preclude any electrolysis performed while supplying oxygen-free gas as gas for stirring the electrolyte and forming an oxide film, as its stirring accelerates the arrival of oxygen dissolved in the electrolyte or oxygen formed at the anodes by electrolysis, which is effective to some extent for the formation of an oxide film. It is desirable in that case, too, that gas in the form of fine bubbles be so supplied as to contact the surfaces of the cathode metal plate.

EXAMPLES (Preparation of Sample Sheets)

[Tin-Coated Steel Sheet]

Low-carbon steel sheet (having a thickness of 0.18 mm) employed as a substrate to be coated was electrolytically degreased in an aqueous alkali solution, pickled by dipping in sulfuric acid, and coated with tin on both sides (with a coating weight of 2.5 g/m$^2$) by using a known ferrostan bath to make a tin-coated steel sheet.

Samples were prepared by forming on both sides of the tin-coated steel sheet an oxide film having the coating weight shown in Table 1 under the treatment conditions shown in Table 1 by employing the oxide coating apparatus shown in FIG. 1 and the electrolyte shown in Table 1. The anodes were the insoluble anodes made by coating the surface of a titanium plate with iridium oxide, the bubble generating means was a hollow circular cylindrical porous body (having a pore diameter of 5 to 250 μm and a void ratio of 60%) formed from a sintered product of a stainless steel (SUS316) powder, and a voltage was applied, while compressed air was supplied from a compressor to the porous body to generate fine bubbles in the electrolyte at a rate of 3.5 liters per minute (Samples Nos. 1, 2, 5 and 6). For comparative purposes, a voltage was applied without any fine bubbles generated in the electrolyte (Samples Nos. 3, 4, 7 and 8).

TABLE 1

| Sample No. | Electrolyte: Kind | Electrolyte: Concentration (g/l) | Electrolytic conditions: Bubble generation | Electrolytic conditions: Current Density ($A/dm^2$) | Electrolytic conditions: Electric charge ($C/dm^2$) | Coating Weight[1)] ($mg/m^2$) | Classification |
|---|---|---|---|---|---|---|---|
| 1 | Potassium zirconium fluoride | 5 | Yes | 5 | 30 | 120 | Invention |
| 2 | Potassium zirconium fluoride | 5 | Yes | 5 | 60 | 250 | Invention |
| 3 | Potassium zirconium fluoride | 5 | No | 5 | 30 | 3 | Comparative |
| 4 | Potassium zirconium fluoride | 5 | No | 5 | 60 | 4 | Comparative |
| 5 | Aluminum sulfate | 5 | Yes | 5 | 30 | 105 | Invention |
| 6 | Aluminum sulfate | 5 | Yes | 5 | 60 | 125 | Invention |
| 7 | Aluminum sulfate | 5 | No | 5 | 30 | 30 | Comparative |
| 8 | Aluminum sulfate | 5 | No | 5 | 60 | 47 | Comparative |

Note:
[1)]In terms of metallic zirconium or aluminum.

As is obvious from the table, the oxide coating of any sample prepared by applying a voltage, while generating fine bubbles of gas containing oxygen in the electrolyte can be formed by employing only a by far smaller amount of electric charge than the oxide coating of any comparative sample prepared by applying a voltage without generating fine bubbles of gas containing oxygen in the electrolyte can, when they are formed with the same coating weight.

INDUSTRIAL APPLICABILITY

According to the present invention, the oxide coating method in which a direct current voltage is applied between the anodes and the cathode formed from a metal plate to coat it with an oxide, while gas is supplied into the electrolyte, and the oxide coating apparatus having the anodes, the cathode formed from a metal plate and the bubble generating means for supplying gas into the electrolyte, make it possible to form an oxide film having the necessary thickness by employing a smaller amount of electric charge than when electrolysis is performed without any oxygen or like gas supplied into the electrolyte. This is due to the fact that stirring by gas accelerates the arrival at the cathode of oxygen dissolved in the electrolyte and oxygen produced at the anodes by electrolysis and thereby exerts a positive effect on the formation of an oxide film. The constant supply of oxygen to the surface of the metal plate used as the cathode enables the formation of an oxide film to proceed more efficiently. The supply of fine bubbles of oxygen to the surface of the metal plate as the cathode enables the formation of an oxide film to take place still more efficiently. The supply of the gas in contact with the cathode surface is particularly effective for eliminating any variation occurring in concentration near the cathode surface and forming an oxide film very efficiently.

As it is possible to obtain a uniform film having the necessary thickness more reliably with a smaller amount of electric charge than when employing a treating solution prepared by adding an oxidizing agent to the electrolyte, it is possible to manufacture an oxide-coated metal sheet at a low cost.

The invention claimed is:

1. A method for providing an oxide coating on a cathode metal plate, comprising applying a direct current voltage in an electrolyte containing zirconium or aluminum between an insoluble anode and the cathode metal plate positioned opposite the anode, wherein the anode and the cathode are facing parallel each other with space therebetween, wherein the insoluble anode is a titanium plate coated with iridium oxide, wherein the cathode is a low carbon steel sheet, a nickel coated low carbon steel sheet, or a tin-coated low carbon steel sheet, and supplying gas into the electrolyte to coat the cathode with zirconium oxide or aluminum oxide, wherein the gas is oxygen, or a gas containing oxygen, wherein the gas is supplied through bubble generating means situated below or beside the space between the anode and cathode, wherein the gas is so supplied as to contact the cathode surface.

2. An oxide coating method as set forth in claim 1, wherein the gas is supplied in the form of bubbles generated from pores having a size of 1 to 1,000 μm.

3. An oxide coating apparatus adapted to provide an oxide coating on a cathode, comprising:

an insoluble anode comprising a titanium plate coated with iridium oxide, and a cathode situated opposite the anode in an electrolyte containing zirconium or aluminum, the cathode being formed from a metal plate adapted and arranged to be coated with an oxide of zirconium or an oxide of aluminum, wherein the cathode is formed of low carbon steel, tin or nickel plated low carbon steel, or tin plated low carbon steel, wherein the anode and the cathode are facing parallel each other with a space therebetween, wherein bubble generating means for supplying gas into the electrolyte is situated below or beside the space between the anode and cathode, wherein the gas is oxygen, or a gas containing oxygen, and wherein the bubble generating means is a porous body connected to a source of gas supply.

4. An oxide coating apparatus as set forth in claim 3, wherein the porous body has a pore diameter of 1 to 1,000 μm and a void ratio of 5 to 95%.

5. An oxide coating apparatus as set forth in claim 3, wherein the porous body is a sintered body of any of a metal powder, a ceramic powder and an organic resin powder.

6. An oxide coating apparatus as set forth in claim 3, wherein the porous body is a foamed product of any of a foamed metal, a foamed ceramic and a foamed organic resin having open cells.

* * * * *